US006994131B2

(12) United States Patent
Dedmon

(10) Patent No.: US 6,994,131 B2
(45) Date of Patent: Feb. 7, 2006

(54) CARRY-ALL BAG

(76) Inventor: Mamie Dedmon, 201 E. Fariston Dr., Philadelphia, PA (US) 19120

( * ) Notice: Subject to any disclaimer, the term of this patent is extended or adjusted under 35 U.S.C. 154(b) by 69 days.

(21) Appl. No.: 10/454,090

(22) Filed: Jun. 4, 2003

(65) Prior Publication Data

US 2003/0226626 A1 Dec. 11, 2003

Related U.S. Application Data

(60) Provisional application No. 60/387,068, filed on Jun. 7, 2002.

(51) Int. Cl.
*A45C 1/02* (2006.01)
*A45C 3/06* (2006.01)

(52) U.S. Cl. ..... 150/106; 150/112; 150/117; 190/109; 190/111; 206/541; 383/38

(58) Field of Classification Search ..... 150/106, 150/112, 113, 117; 190/109, 111; 206/541, 206/546; 383/38, 40
See application file for complete search history.

(56) References Cited

U.S. PATENT DOCUMENTS 1,559,307 A * 10/1925 Bernardo ..... 190/111
1,628,812 A * 5/1927 Shwayder ..... 190/109
1,951,527 A * 3/1934 Oas ..... 190/109
2,213,821 A * 9/1940 McCurdy ..... 190/111
2,705,063 A * 3/1955 Torrent ..... 190/111
2,788,823 A * 4/1957 Walser ..... 150/113
3,870,132 A * 3/1975 Hanley ..... 190/109
3,963,102 A * 6/1976 Carp ..... 190/108
4,171,011 A * 10/1979 Kopin ..... 150/117
4,212,377 A * 7/1980 Weinreb ..... 190/109
4,354,542 A * 10/1982 Gerch ..... 150/108
4,867,215 A * 9/1989 Macieowitz ..... 150/112
4,941,603 A * 7/1990 Creamer et al. ..... 224/148.3
5,038,842 A * 8/1991 Huang ..... 150/113
5,159,999 A * 11/1992 Voigt ..... 190/111
5,356,004 A * 10/1994 Weinreb ..... 206/316.2
5,806,981 A * 9/1998 Schisler ..... 383/38
5,842,571 A * 12/1998 Rausch ..... 206/549
5,950,834 A * 9/1999 Woodnorth et al. ..... 206/541
6,047,752 A * 4/2000 Southwick ..... 150/117
6,702,167 B2 * 3/2004 Annis ..... 224/576
2004/0007486 A1 * 1/2004 Bergh et al.

FOREIGN PATENT DOCUMENTS

FR 2641170 * 7/1990

* cited by examiner

*Primary Examiner*—Sue A. Weaver
(74) *Attorney, Agent, or Firm*—Paul & Paul

(57) ABSTRACT

A carry-all bag is disclosed having a main compartment, a side compartment for an umbrella, and a bottom compartment for a microwaveable dish. The main compartment may have additional compartments for magazines, mobile phone, change, and water or beverage bottle.

15 Claims, 2 Drawing Sheets

CARRY-ALL BAG

CROSS REFERENCE TO RELATED APPLICATIONS

This application claims the benefit of my priority U.S. Provisional Application, Ser. No. 60/387,068, Filed Jun. 7, 2002, the entire disclosure of which is incorporated herein by reference.

BACKGROUND OF THE INVENTION

1. Field of the Invention

The present invention relates to a bag of the type known as a carry-all or tote bag.

2. Background and Description of the Prior Art

Many types of bags are known in the art, however, none are seen to offer the combination of features provided by the present invention.

SUMMARY OF THE INVENTION

The present invention is directed to a carry-all bag having a main compartment, a side compartment for an umbrella, and a bottom compartment for a microwaveable dish. The main compartment may have additional compartments for magazines, mobile phone, change, and water or beverage bottle.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
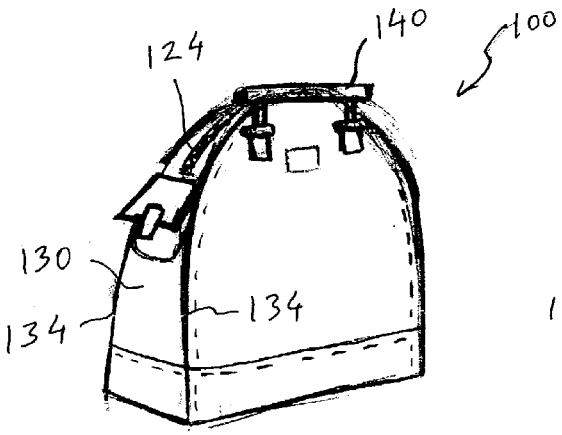
FIG. 1 is a front perspective view of a bag according to the present invention.
Figure 2:
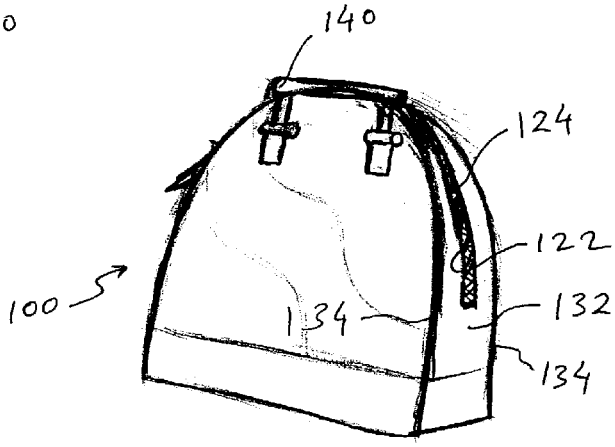
FIG. 2 is a rear perspective view of a bag according to the present invention.

Referring to FIGS. 1–7, the present invention is directed to a carry-all bag 100 having a main compartment 102, a side compartment 104 for an umbrella 106, and a bottom compartment 108 for a microwaveable or microwave-safe dish (not shown). The main compartment 102 may have additional compartments 112, 114, 116 and 118 for magazines, mobile phone or eyeglasses, change, and water or beverage bottle 120, respectively.

The main compartment 102 is preferably large and spacious and has a top opening 122 that is secured by a zipper 124. In the illustrated example, the main compartment 102 is defined by right, left, front and rear panels, 126, 128, 130, and 132 respectively, that are sewn together at seams 134. The bag 100 also has a bottom panel 136 that is sewn to the right, left, front and rear panels along seams 138. The bag 100 is preferably provided with handles 140.

A portion of the interior volume of the bag 100 near the bottom of the bag is divided into three portions 142, 144, and 146 by partitions 148 and 150. The middle portion 144 defines the compartment 108 that is dimensioned and configured to receive a microwave-safe dish of the type having a lid. The portion 142 defines a space for receiving a base portion of a water or beverage bottle 120, thus defining at least in part the location of the compartment 118. The bottle 120 is securely held in place by a pouch 152 that is sewn to the interior of the bag near the side 132 of the bag 100. The pouch 152 has an open top and can be accessed through the top opening 122 of the bag 100.

The portion 146 defines a space for receiving an end portion of a folding or collapsible umbrella 106. Thus the portion 146 defines at least in part the location of the compartment 104. The umbrella 106 is securely held in place by a pouch 154 that is sewn to the interior of the bag near the side 130 of the bag 100. The pouch 154 at least in part defines the compartment 104. The pouch 154 has an open top that is accessed from the exterior of the bag 100. The opening of the umbrella pouch may be provided with a closure flap 156 that is releasably securable in at least the closed position by a hook-and-loop fastener, a snap fastener, or any other type of fastener well known for this purpose. The pouch 154 is preferably provided with a waterproof lining 155 to prevent water from a wet umbrella from infiltrating the interior of the bag 100.

The compartment 108 has an open top that is accessed through the top opening 122 of the bag 100. The opening of the compartment 108 is provided with a closure flap 158 that is roughly rectangular. The closure flap 158 is sewn or is otherwise secured to the interior of the bag at one of the sides 126 or 128 of the bag 100 along one side of the flap 158 to provide a flexible hinge about which the flap 158 can be pivotally moved. The side of the flap 158 distal from the hinged side is provided with one or more hook-and-loop fasteners, snap fasteners, or other well known fasteners to releasably secure the flap 158 at least in the closed position.

The closure flap 158 acts as a closure for the top opening of the bottom compartment 108 and is movable between open and closed positions. The closure flap 158 allows access to the compartment 108 when it is in the open position. The closure flap 158 acts as the bottom for the main compartment 102 of the bag 100 such that objects placed in the main compartment 102 are supported by the closure flap 158 when the closure flap 158 is in the closed position.

A compartment 112, in the form of a pouch or pocket, may be provided on the interior of the side 126 of the bag 100 for magazines or newspapers. The compartment 112 has an open top which may optionally be provided with a closure flap that is releasably securable in at least the closed position by a hook-and-loop fastener, a snap fastener, or any other type of fastener well known for this purpose.

A compartment 114, in the form of a pouch or pocket, may be provided on the interior of the side 128 of the bag 100 for holding a mobile phone or sunglasses. The compartment 114 may be provided with a closure flap 160 that is releasably securable in at least the closed position by a hook-and-loop fastener, a snap fastener, or any other type of fastener well known for this purpose.

A compartment 116, in the form of a pouch or pocket, may be provided on the interior of the side 128 of the bag 100 for carrying change. The compartment 116 may be provided with a zippered closable opening or an opening having a closure flap that is releasably securable in at least the closed position by a hook-and-loop fastener, a snap fastener, or any other type of fastener well known for this purpose.

The bag 100 is generally of the soft-sided luggage type and may be made of canvas, Nylon fabric, simulated and/or natural leather and the like. The partitions 148 and 150 may have cardboard, plastic, or foam inserts for added rigidity and to hold their shape better. Alternatively, the 148 and 150 may be integral parts of a multi-compartment fabric-covered tray placed at the bottom of the bag 100 to give the bag 100 added rigidity, help the bag 100 hold its shape and help the bag 100 remain upright when placed on a level surface. Additionally, all the various closure flaps, panels and pouches of the bag 100 may be provided with cardboard, plastic, or foam inserts for added rigidity and to better hold their shape.

Furthermore, the preferred embodiment disclosed herein is susceptible to various modifications without departing from the scope of the invention. For example, the pouch for the water bottle may also have a waterproof lining 119 to prevent condensation from wetting the contents of the bag 100. As yet another alternative, the pouches for the water bottle and umbrella may be provided on the exterior of the bag 100, and the various pockets and pouches of the bag 100 may be provided with or without closure panels. As yet another alternative, the compartment 108 may be provided with access from the exterior of the bag 100.

It is to be understood that the present invention is not limited to the embodiments described above, but encompasses any and all embodiments within the scope of the following claims.

I claim:

1. A bag comprising:

a main compartment having a top opening;

a bottom compartment having a top opening and adapted to receive a microwave-safe dish;

a side compartment for an umbrella;

a compartment for receiving a bottle; and a closure flap for said bottom compartment, said closure flap acting as a closure for said top opening of said bottom compartment and being movable between open and closed positions, said closure flap acting as the bottom for said main compartment when said closure flap is in said closed position, wherein the bag has a bottom and an interior defining an interior volume, a portion of said interior volume of the bag adjacent said bottom of the bag is divided by at least a first partition and a second partition, said second partition being spaced apart from said first partition such that said portion of said interior volume of the bag adjacent said bottom of said bag is divided into a first side portion, a middle portion, and a second side portion by said first and second partitions, said middle portion defining said bottom compartment that is dimensioned and configured to receive a microwave-safe dish, said first side portion defining said space for receiving a base portion of a bottle to thereby define at least in part the location of said compartment for receiving a bottle, and said second side portion defining a space for receiving an end portion of a folding or collapsible umbrella such that said second side portion defines at least in part the location of said side compartment for an umbrella, and wherein the bag further comprises a first pouch that is attached to said interior of said bag near said first side portion of said portion of the interior volume of the bag adjacent the bottom of the bag in order to securely hold the bottle in place when the base portion of the bottle is received in said first side portion, and said first pouch has an open top and can be accessed through said top opening of the bag.

2. The bag according to claim 1, further comprising first, second, and third additional compartments adapted to receive magazines, a mobile phone or eyeglasses, and change, respectively.

3. The bag according to claim 2, wherein said top opening of said main compartment is provided with a zipper such that said top opening of said main compartment can be secured by said zipper.

4. The bag according to claim 3, wherein the bag is provided with handles.

5. The bag according to claim 1, wherein said top opening of said main compartment is provided with a zipper such that said top opening of said main compartment can be secured by said zipper.

6. The bag according to claim 5, wherein the bag is provided with handles.

7. The bag according to claim 1, wherein the bag further comprises a second pouch that is attached to said interior of said bag near said second side portion of said portion of the interior volume of the bag near the bottom of the bag in order to securely hold the umbrella in place when the umbrella is received in said second pouch.

8. The bag according to claim 7, wherein said second pouch has an open top that is accessed from the exterior of the bag.

9. The bag according to claim 8, wherein said open top of said second pouch is provided with a closure flap that is releasably securable in at least the closed position by a fastening means.

10. The bag according to claim 9, wherein said second pouch is provided with a waterproof lining to prevent water from a wet umbrella from infiltrating the interior of the bag.

11. The bag according to claim 10, wherein said middle portion defines said bottom compartment, and said top opening of said bottom compartment is accessed through said top opening of said main compartment.

12. The bag according to claim 11, wherein said closure flap of said bottom compartment is roughly rectangular, said closure flap of said bottom compartment is provided with a fastening means to releasably secure said closure flap of said bottom compartment at least in a closed position, and said closure flap of said bottom compartment serves as a bottom surface for said main compartment such that objects placed in said main compartment can be supported by said closure flap of said bottom compartment when said closure flap of said bottom compartment is in said closed position.

13. The bag according to claim 12, further comprising first, second, and third additional compartments adapted to receive magazines, a mobile phone or eyeglasses, and change, respectively.

14. The bag according to claim 1, wherein the closure flap is sewn to the interior of the bag at one side of the bag along one side of said closure flap to provide a flexible hinge about which said closure flap can be pivotally moved.

15. The bag according to claim 14, wherein said closure flap of said bottom compartment is roughly rectangular and said closure flap of said bottom compartment is provided with a fastening means to releasably secure said closure flap of said bottom compartment at least in a closed position.

* * * * *

UNITED STATES PATENT AND TRADEMARK OFFICE

CERTIFICATE OF CORRECTION

PATENT NO. : 6,994,131 B2
APPLICATION NO. : 10/454090
DATED : February 7, 2006
INVENTOR(S) : Dedmon It is certified that error appears in the above-identified patent and that said Letters Patent is hereby corrected as shown below:

Delete Title page illustrating a figure(s), and substitute therefor, new Title page illustrating a figure(s). (attached)

Delete drawing sheet 1-3, and substitute therefor drawing sheet 1-3. (attached)

Signed and Sealed this

Seventeenth Day of July, 2007

JON W. DUDAS
*Director of the United States Patent and Trademark Office*

(12) United States Patent
Dedmon

(10) Patent No.: US 6,994,131 B2
(45) Date of Patent: Feb. 7, 2006

(54) CARRY-ALL BAG

(76) Inventor: Mamie Dedmon, 201 E. Fariston Dr., Philadelphia, PA (US) 19120

( * ) Notice: Subject to any disclaimer, the term of this patent is extended or adjusted under 35 U.S.C. 154(b) by 69 days.

(21) Appl. No.: 10/454,090

(22) Filed: Jun. 4, 2003

(65) Prior Publication Data

US 2003/0226626 A1 Dec. 11, 2003

Related U.S. Application Data

(60) Provisional application No. 60/387,068, filed on Jun. 7, 2002.

(51) Int. Cl.
*A45C 1/02* (2006.01)
*A45C 3/06* (2006.01)

(52) U.S. Cl. ..... 150/106; 150/112; 150/117; 190/109; 190/111; 206/541; 383/38

(58) Field of Classification Search ..... 150/106, 150/112, 113, 117; 190/109, 111; 206/541, 206/546; 383/38, 40
See application file for complete search history.

(56) References Cited

U.S. PATENT DOCUMENTS 1,559,307 A * 10/1925 Bernardo ..... 190/111
1,628,812 A * 5/1927 Shwayder ..... 190/109
1,951,527 A * 3/1934 Oas ..... 190/109
2,213,821 A * 9/1940 McCurdy ..... 190/111
2,705,063 A * 3/1955 Torrent ..... 190/111
2,788,823 A * 4/1957 Walser ..... 150/113
3,870,132 A * 3/1975 Hanley ..... 190/109
3,963,102 A * 6/1976 Carp ..... 190/108
4,171,011 A * 10/1979 Kopin ..... 150/117
4,212,377 A * 7/1980 Weinreb ..... 190/109
4,354,542 A * 10/1982 Gerch ..... 150/108
4,867,215 A * 9/1989 Maciocowitz ..... 150/112
4,941,603 A * 7/1990 Creamer et al. ..... 224/148.3
5,038,842 A * 8/1991 Huang ..... 150/113
5,159,999 A * 11/1992 Voigt ..... 190/111
5,356,004 A * 10/1994 Weinreb ..... 206/316.2
5,806,981 A * 9/1998 Schister ..... 383/38
5,842,571 A * 12/1998 Rausch ..... 206/549
5,950,834 A * 9/1999 Woodnorth et al. ..... 206/541
6,047,752 A * 4/2000 Southwick ..... 150/117
6,702,167 B2 * 3/2004 Annis ..... 224/576
2004/0007486 A1 * 1/2004 Bergh et al.

FOREIGN PATENT DOCUMENTS

FR 2641170 * 7/1990

* cited by examiner

*Primary Examiner*—Sue A. Weaver
(74) *Attorney, Agent, or Firm*—Paul & Paul

(57) ABSTRACT

A carry-all bag is disclosed having a main compartment, a side compartment for an umbrella, and a bottom compartment for a microwaveable dish. The main compartment may have additional compartments for magazines, mobile phone, change, and water or beverage bottle.

15 Claims, 2 Drawing Sheets

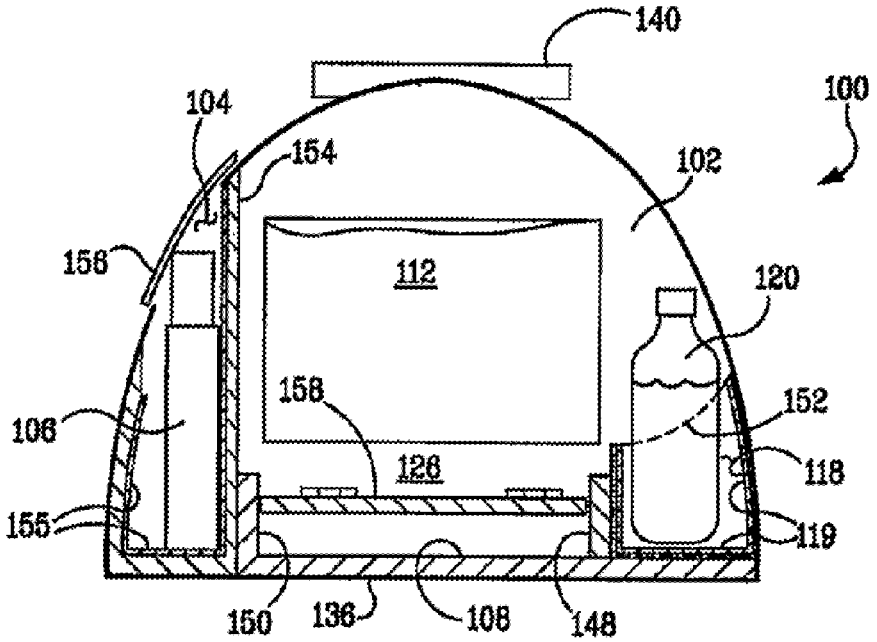

Figure 3:
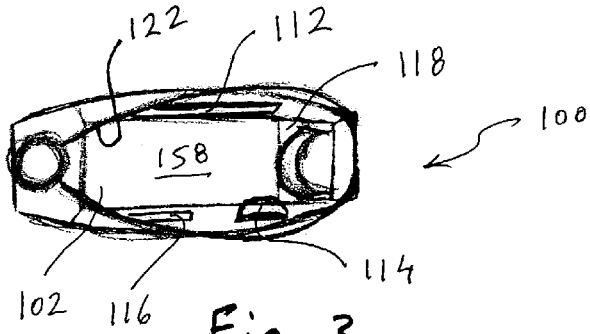
FIG. 3 is a top view of a bag according to the present invention, the bag being open to reveal the interior.
Figure 5:
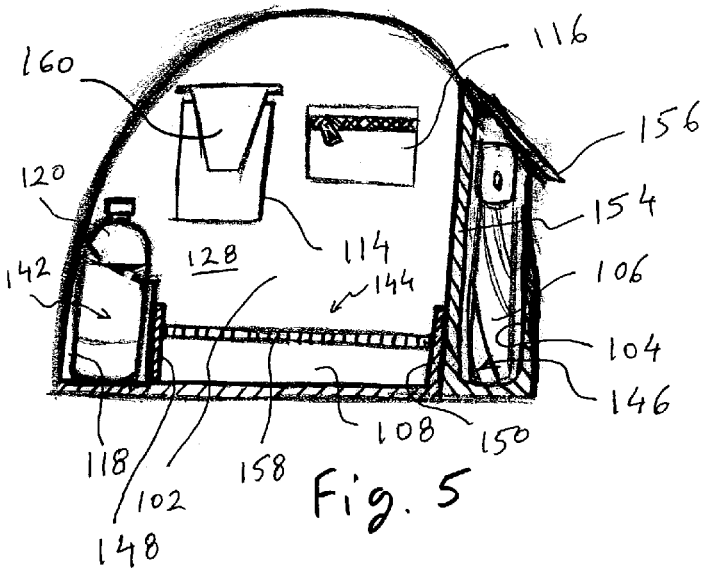
FIG. 5 is a cross section through a bag according to the present invention showing the interior of the left side of the bag.
Figure 7:
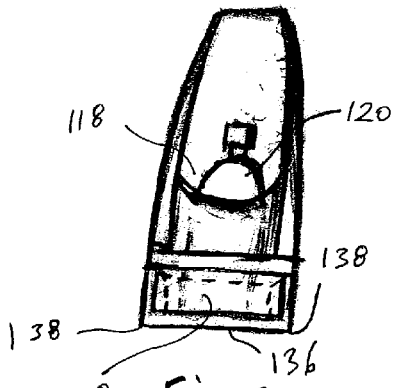
FIG. 7 is a cross section through a bag according to the present invention showing the interior of the rear side of the bag.
Figure 4:
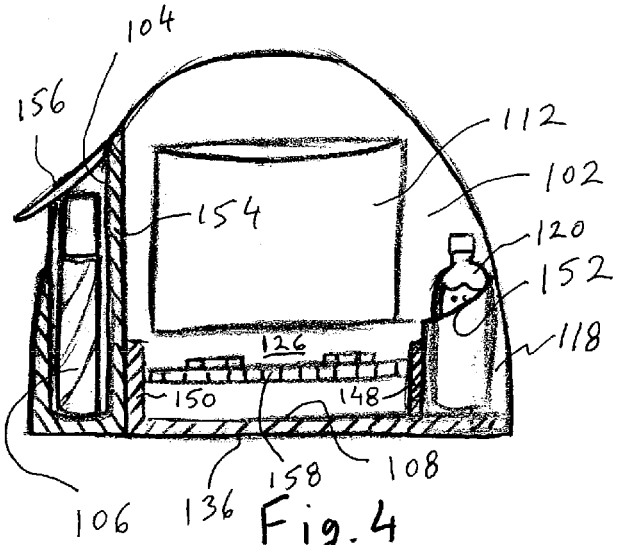
FIG. 4 is a cross section through a bag according to the present invention showing the interior of the right side of the bag.
Figure 6:
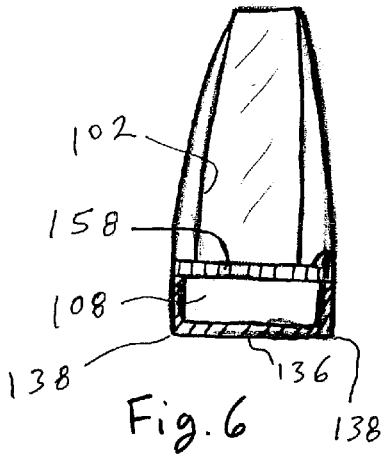
FIG. 6 is a cross section through a bag according to the present invention showing the interior of the front side of the bag.
Figure 4:
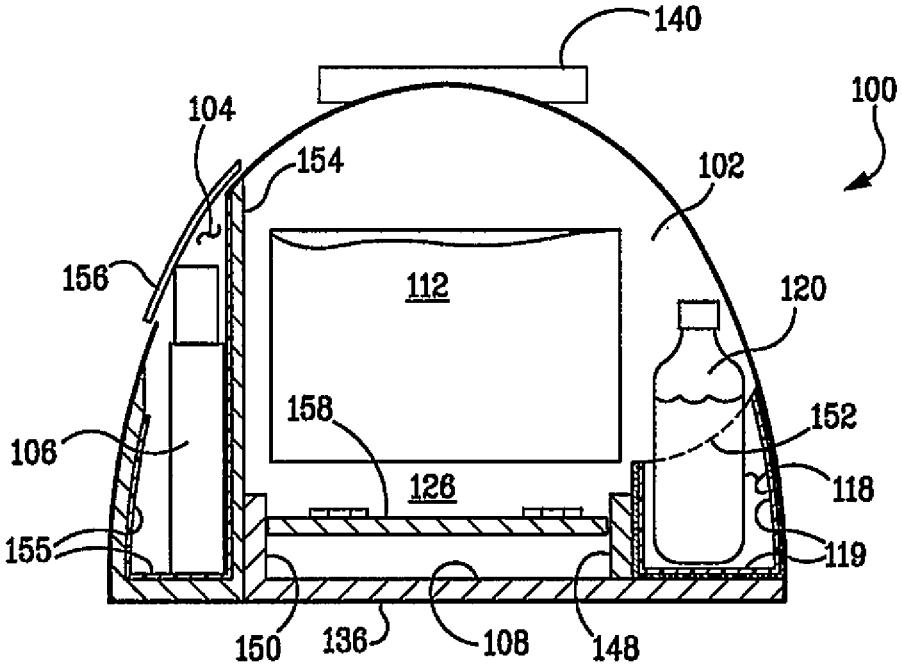
Figure 5:
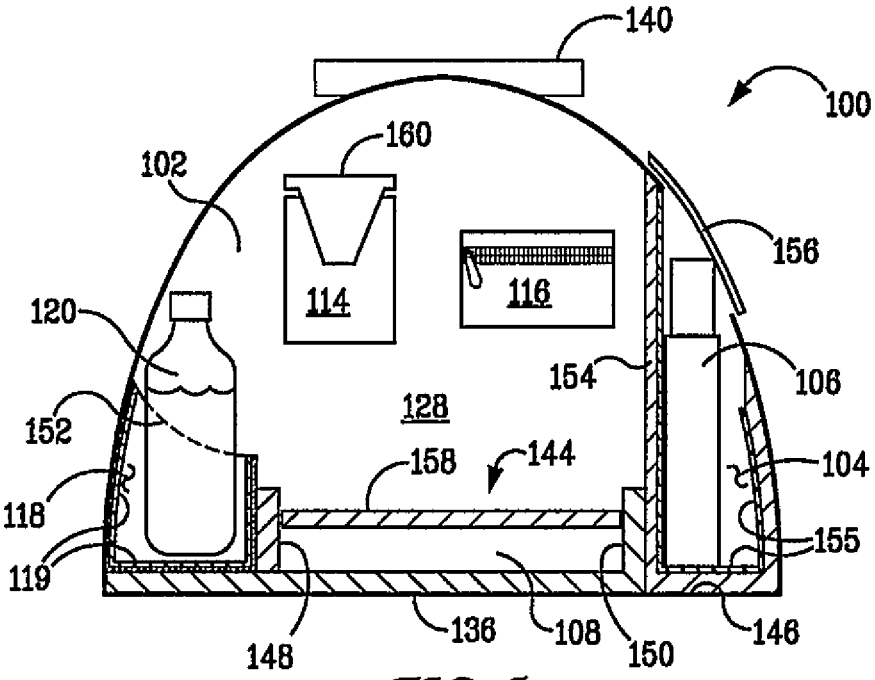
Figure 6:
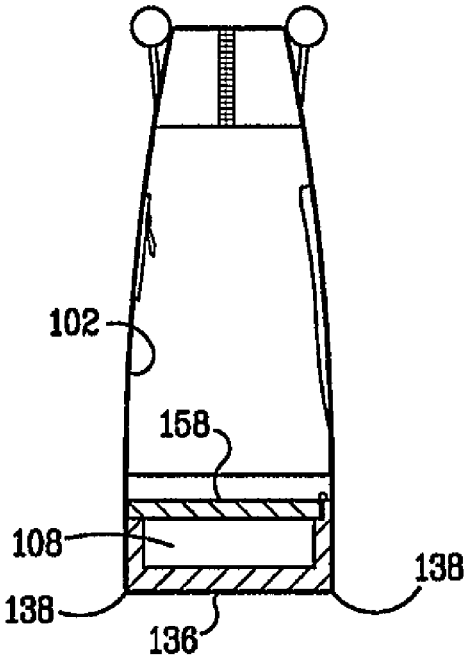
Figure 7:
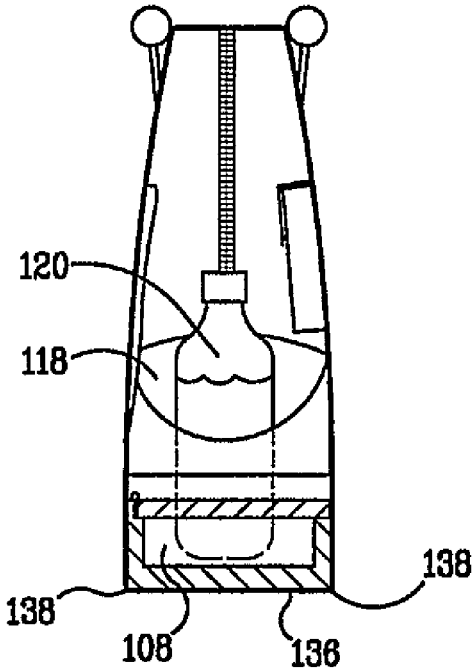

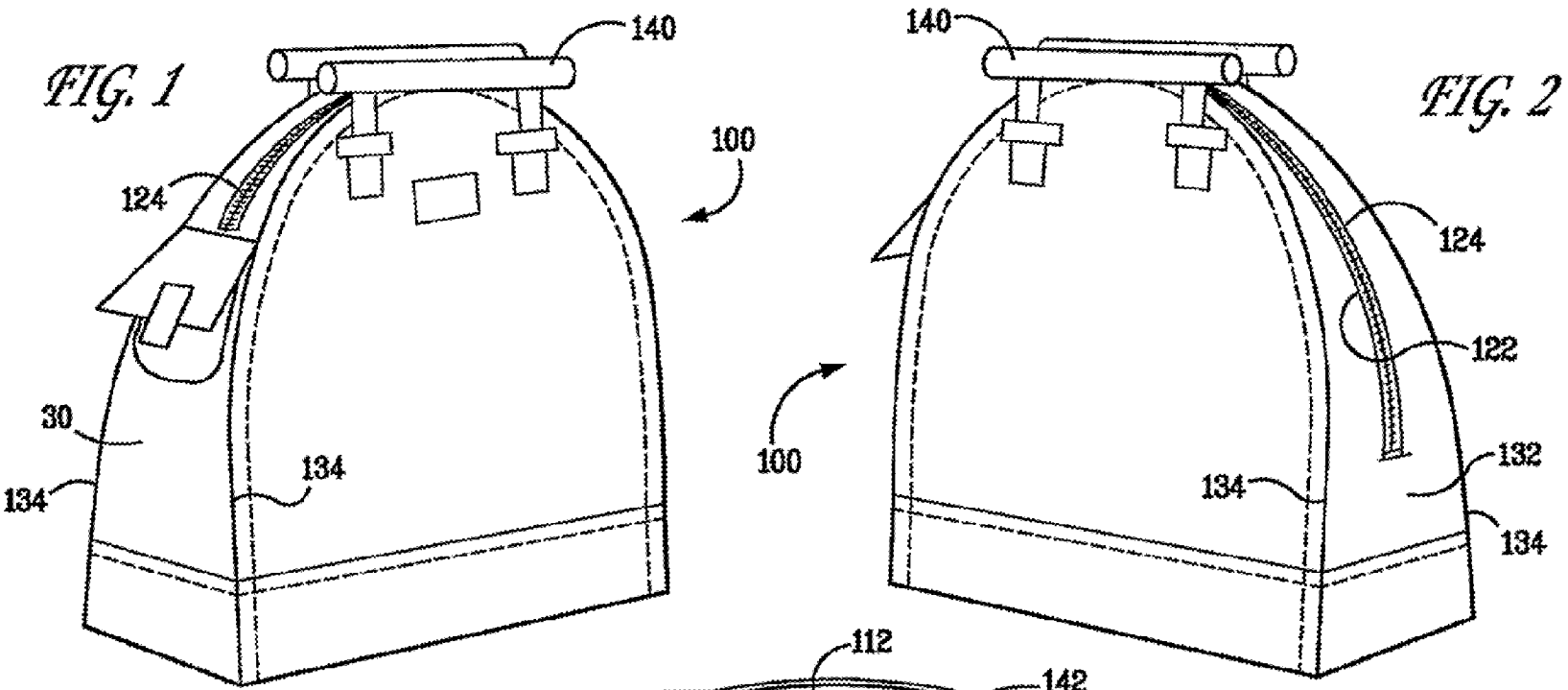
FIG. 2
124
122
132
134
134
140
100
100
140
134
124
30
134
FIG. 1
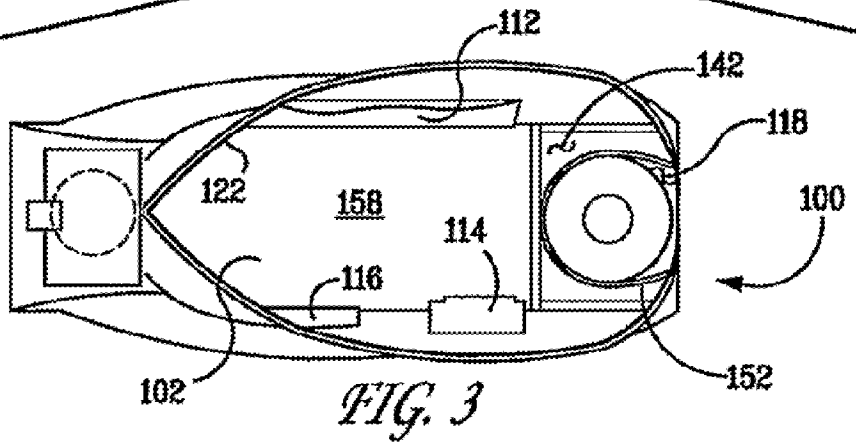
100
118
142
152
112
114
158
116
122
102
FIG. 3